United States Patent [19]

Glynn

[11] Patent Number: 5,054,576

[45] Date of Patent: Oct. 8, 1991

[54] ROOF LIFELINE SAFETY SYSTEM AND ANCHOR ASSEMBLY THEREFOR

[75] Inventor: William D. Glynn, West Suffield, Conn.

[73] Assignee: SINCO, Incorporated, East Hampton, Conn.

[21] Appl. No.: 586,895

[22] Filed: Sep. 24, 1990

[51] Int. Cl.[5] ..... A62B 35/00

[52] U.S. Cl. ..... 182/3; 248/237

[58] Field of Search ..... 182/3, 5, 231, 45; 248/237

[56] References Cited

U.S. PATENT DOCUMENTS

| | | | |
|---|---|---|---|
| 2,439,063 | 4/1948 | Shur | 248/237 |
| 2,628,796 | 2/1953 | Krizman | 248/237 |
| 3,022,855 | 2/1962 | Lewis | 182/3 |
| 3,269,679 | 8/1966 | Grappo | 248/237 |
| 4,226,058 | 10/1980 | Riley | 248/237 |
| 4,249,713 | 2/1981 | Glynn | 248/237 |
| 4,942,943 | 7/1990 | Flaherty | 182/231 |

*Primary Examiner*—Reinaldo P. Machado

*Attorney, Agent, or Firm*—Chilton, Alix & Van Kirk

[57] ABSTRACT

A lifeline safety system for a pitched roof employs a frame for mounting a lifeline system above the peak of the roof. Shoulders extend from the frame and engage opposing sides of the roof. An anchor comprising a generally J-shaped bolt secures the bracket assembly to the roof. The bolt has a hook which engages the underside of the rafter. A nut has a pair of arms for torquing the nut to the bolt.

10 Claims, 2 Drawing Sheets

ROOF LIFELINE SAFETY SYSTEM AND ANCHOR ASSEMBLY THEREFOR

BACKGROUND OF THE INVENTION

This invention relates generally to safety systems and devices for insuring the safety of workers while positioned on a roof. More particularly, the present invention relates generally to safety systems and devices for preventing roofers, construction workers or the like from accidentally falling from a pitched roof.

A number of devices have been employed to prevent roofers, construction workers and other individuals from accidentally falling off roofs during construction, maintenance or other activities. Pitched roofs which have significant pitched portions or severe pitch angles may pose very hazardous risks to the safety of a worker. The danger potential associated with a pitched roof working environment has become widely recognized, and there has been an increased regulatory focus on ensuring safety for pitched roof structures.

Lifelines which may be retractable and various safety rails have conventionally been employed as safety devices in connection with the construction and maintenance of pitched roofs. In conventional safety systems, the lifelines are rigidly anchored to a fixed structure and connect with a safety belt worn by the worker. The extendable length of the lifeline is effectively restricted so that an accidental fall or rapid change of position of the worker is prevented by automatic locking of the position of the lifeline or the position of an auxiliary lifeline carried by a principal safety cable. One of the critical problems which is encountered in connection with such safety systems is anchoring the safety device to the roof structure so that the safety device remains anchored should it be subject to severe loading due to an accidental fall or usage in an emergency situation.

SUMMARY OF THE INVENTION

Briefly stated, the invention in a preferred form is a safety system which is especially adaptable for use in connection with a pitched roof. The system employs a lifeline which is receivable in a casing and is extendable and retractable so as to provide a variable length from an anchoring position as the requirements of a given job may dictate. The lifeline may be a self-contained centrifugal locking/rewinding system which employs a stainless steel cable. The lifeline is mounted in an upright bracket assembly for disposition generally above at the peak of the roof. The lifeline housing is secured to the bracket assembly.

A frame receives the lifeline housing so that the line outlet from the housing is oriented upwardly from the roof peak. Shoulders extend from the frame and are oriented for surface-to-surface engagement on opposing sides of the pitched roof. Anchors are inserted through openings of the shoulders and are secured to the roof for anchoring the bracket assembly and hence the lifeline to the roof. A spring is mounted proximate the output portion of the housing surrounding the proximal portions of the extendable lifeline so as to ensure that the lifeline is spaced above the roof. A loop or carabiner at the end of the lifeline attaches to a safety belt worn by the worker.

An anchor bolt for securing the bracket assembly to the roof comprises a generally J-shaped member comprising an elongated shank having a threaded surface and a hook which engages the underside of a roof rafter.

A plate defining an opening is mounted to the shank by inserting the shank through the opening. A nut is threadably engageable with the threaded surface of the shank for longitudinal displacement therealong upon application of a torque to the nut. The underside of the nut is engageable against the top of the plate. The nut comprises a pair of arms extending generally transversely thereto for torquing the nut. The upper portion of the anchor terminates in an eye. Various cables and lifelines may be connected through the eye.

The anchor is dimensioned so that it may be mounted in place by inserting the distill hook portion through an opening in the roof and positioning the hook portion of the anchor so as to engage the underside of the roof rafter. The plate engages the exterior roof and the nut is tightened against the plate to thereby securely anchor the anchor bolt to the roof.

An object of the invention is to provide a new and improved safety system which is adaptable for a pitched roof to protect workers from falling.

Another object of the invention is to provide a new and improved anchor assembly of efficient construction for anchoring a safety system to a roof in a safe and reliable manner.

A further object of the invention is to provide a new and improved means for mounting a retractable lifeline employing a centrifugal locking/rewinding system in a secure fixed position on a pitched roof.

Other objectives and advantages of the invention will become apparent from the drawings and the specification.

DETAILED DESCRIPTION OF THE PREFERRED EMBODIMENT

Figure 2:
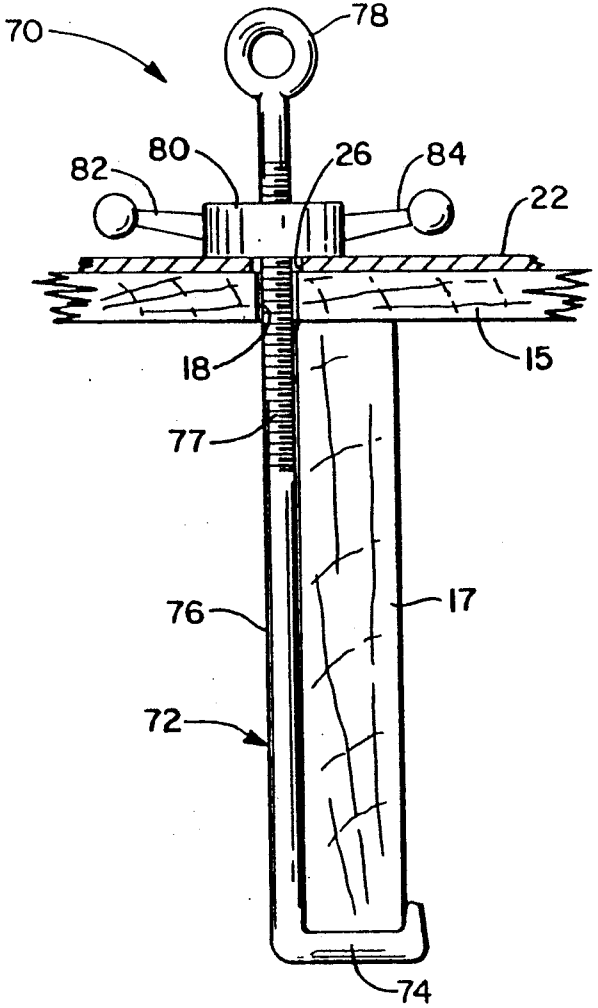
FIG. 2 is an enlarged sectional view of an anchor of FIG. 1 and a portion of the pitched roof illustrating the mounted configuration of the anchor.

With reference to the drawings wherein like numerals represent like parts throughout the several figures, a lifeline safety system in accordance with the present invention is generally designated by the numeral 10. The safety system 10 is generally adapted to provide a lifeline for an individual working on a pitched roof 12 having a peak 14. The illustrated pitched roof 12 is intended to be illustrative of a preferred environment for the invention and is not a limitation of the applicability of the invention. The worker preferably wears a safety belt or harness (not illustrated) which connects with the lifeline.

The safety system 10 comprises a mounting bracket assembly 20 which is supported by a pair of generally rectangular base plates 22 and 24. The base plates are disposed at an angle which is preferably substantially equal to the angle of the intersection at the peak of the pitched portions of the roof. The base plates may be connected by a hinge 28 so that the angle may be varied to accommodate a given roof pitch. Each of the base plates 22 and 24 engage opposing pitched portions of the roof in generally surface-to-surface contact. Each base plate has an opening 26 (FIG. 2) for receiving an anchor as detailed below.

A box-like frame 30 extends vertically upwardly from the base plates and is generally symmetric to a vertical plane through the intersection of the base plates. The frame 30 includes opposing front and rear panels 32 and 34 and substantially identical end panels 36. Openings may be formed in the panels to allow for water draining. The panels extend vertically and cooperate to form an enclosure having a retangular open end 38 at the top thereof. The front panel 32 ma be hinged to the base plate 22 for a bracket assembly embodiment which accommodates various pitch angles. For a fixed pitch embodiment, the panels are joined along their bottom edge portions to the base plates and are configured to accommodate the pitched orientation of the base plates. In some embodiments the frame 30 may be rotated 90° relative to the base plates in comparison to the orientation illustrated in the drawings.

The frame opening 38 and the frame plates are dimensioned to closely receive the casing or housing for a retractable lifeline system 50. Lifeline system 50 may be a conventional lifeline such as the SINCO Model 64 Retract-A-Matic TM lifeline marketed by the assignee of the present invention. The lifeline system includes a steel housing 52 which houses a self-contained 3/16 inch steel cable 54. The cable terminates with a carabiner 56 for connecting the cable with a safety belt or harness. The cable 54 or lifeline is wound on a reel within the housing and is extendable and retractable to provide a limited length as required for working on the roof. A centrifugal locking/rewinding assembly automatically prevents accidental falls by locking the cable at an attained length upon rapid acceleration tending to unwind (lengthen) the lifeline cable.

Figure 1:
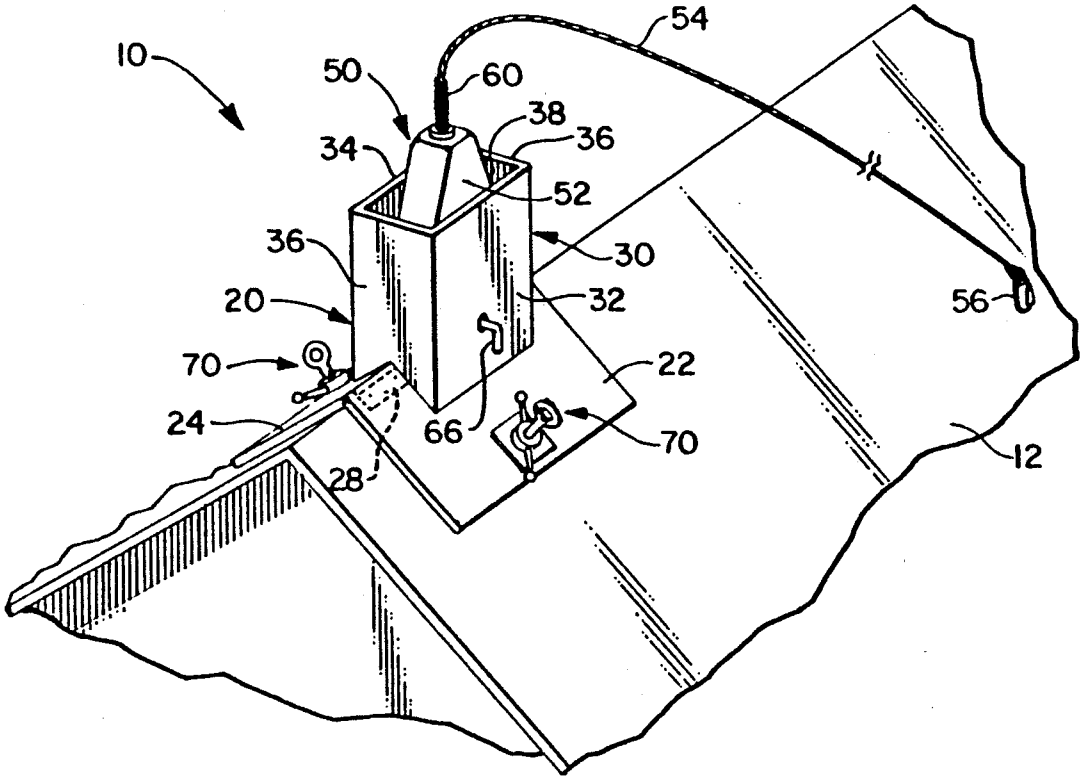
FIG. 1 is a perspective view of the roof lifeline safety system and two anchors therefore in accordance with the present invention, said system being illustrated in conjunction with a pitched roof.
Figure 3:
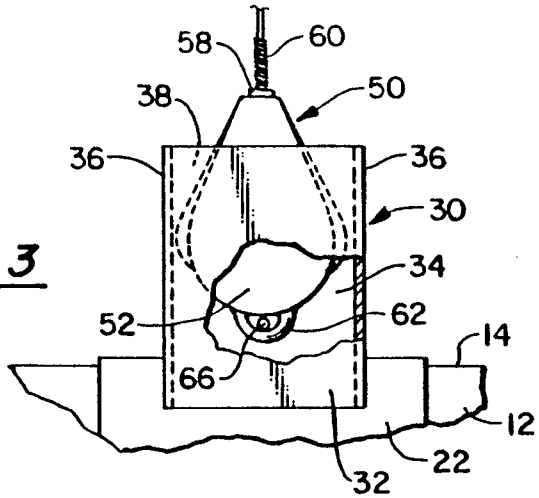
FIG. 3 is an enlarged fragmentary side elevational view, partly broken away, of the lifeline safety system of FIG. 1.
Figure 4:
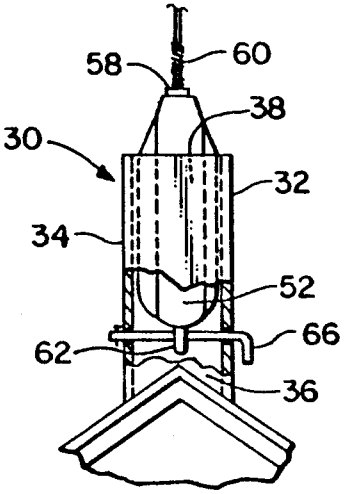
FIG. 4 is an enlarged fragmentary end view, partly broken away and partly in section, of the lifeline safety system of FIG. 1.

The lifeline cable projects through a grommet-like outlet 58 in the housing. A coiled spring 60, which extends generally vertically approximately 6 inches, at the lower end mounts at the outlet. A grommet having an inside diameter 0.05 inches greater than the diameter of the cable and 0.0 greater than the outside diameter of the spring may be employ. The spring 60 surrounds the proximal portion of the lifeline cable which is disposed exteriorly from the housing 52. The housing integrally forms an eye 62 (FIG. 3) at a position (bottom in FIG. 1) generally diametrically opposite the outlet 58 to facilitate mounting or anchoring the lifeline assembly.

A pin 66 is inserted through opposed aligned openings of the frame panels 32 and 34 and the eye 62 of the lifeline assembly to secure the lifeline assembly to the bracket assembly. Other means of securing the lifeline assembly to the frame may also be employed. The lifeline assembly is uprightly oriented and constrained by the frame so that the outlet 58 for the lifeline cable is oriented generally vertically at the top of the housing. The coil spring 60 extends in a generally upward orientation to bias proximal portions of the lifeline to a position vertically positioned above the outlet. The spring 60 thus functions to prevent the lifeline cable 54 from contacting the roof when properly coupled to the safety belt or harness worn by the worker. The spring 60 also prevents the cable from kinking by controllably flexing downwardly to prevent a severe angular bend in the cable.

The bracket assembly 20 is secured to the roof at locations on opposite sides of the peak by means of a pair of anchor assemblies designated generally by the numeral 70. With additional reference to FIGS. 2 and 5, each anchor assembly 70 comprises a generally J-shaped anchor bolt 72 which is inserted through an opening 26 in the base plates and through an opening or bore 18 drilled in the roof. A wing nut 80 threaded to the anchor bolt 72 is torqued against the base plate to securely anchor the bracket assembly to the roof.

With additional reference to FIG. 2, the anchor assembly 70 comprises a generally J-shaped anchor 72 bolt manufactured of steel or other rugged high-strength material. The anchor bolt 72 is configured to include a lower hook 74, an intermediate longitudinally extending shank, 76 and an integral upper eye or connecting ring 78. The diameter of the connecting ring opening may be 2¾inches to 3 inches. So the rim will accept safety snap hooks baring anti-roller features. A threaded surface 77 is formed on the shank. The nut 80 has an interior threaded surface which complements the threaded surface of the bolt. A pair of wing arms 82 and 84 project generally transversely from the body portion of the nut to facilitate manually applying a torque to the nut. In a conventional fashion, the nut is positionable along the shank by manually grasping the wing arms 82 and 84 of the nut to torque the nut to the desired position.

With reference to FIG. 2, the anchor assembly is mounted in position by drilling an opening or bore 18 through the roof substrate 15 in close proximity to a support rafter 17. The bolt 72 is dimensioned for engagement with a rafter which conventionally is either 2 inch×8 inch or a 2 inch×10 inch wood beam (prior to milling) although the anchor may be applicable and accordingly dimensioned to accommodate other support structure types and dimensions. The anchor bolt 72 is inserted through the base plate opening 26 and the roof opening 18 and is rotated and positioned so that the hook 74 engages the underside of the rafter 17 and catches the opposing lower side. The hook 74 preferably has square corners to closely conform to the engaged portions of the rafter. The wing nut 80 is then torqued against the base plate 22 to thereby anchor the base plate to the rafter and adjacent structures of the roof. The threaded surface 77 extends to a pre-established lower limit so as to provide a safety indicator. If the nut bottoms out at the lower limit, the installer will know that the bolt has not properly engaged the rafter.

Figure 5:
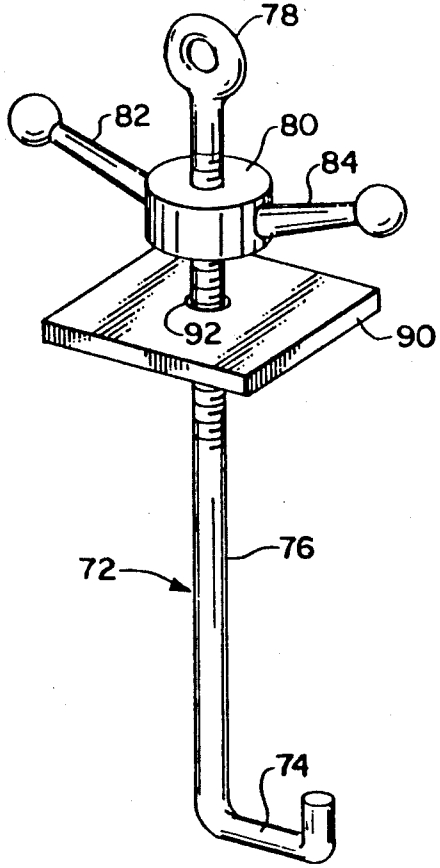
FIG. 5 is a perspective view of an anchor assembly.

With reference to FIG. 5, the anchor may also be employed with other applications. For example, the anchor assembly may be employed as an independent anchor for a cross-wire or other supporting cable (not illustrated). For such applications, a plate 90 which includes an opening 92 dimensioned to permit insertion by the anchor shaft may also be mounted to the anchor bolt. A bore is drilled in the roof adjacent the rafter 17 or other support member. The anchor bolt is then inserted through the opening and positioned as previously described for engagement by the rafter 17. The wing nut 80 is then torqued against the top of the plate 90 to provide a secure fixed mount with roof.

The eye or connector ring 78 which preferably integrally extends from the shaft 76 may be employed for receiving a cable connector or other connector element or the cable may be inserted through the ring and secured in various manners.

While a preferred embodiment of the foregoing invention has been set forth purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety system for a pitched roof comprising:

lifeline means comprising a housing, a lifeline receivable by said housing and extendable and retractable relative thereto;

bracket means for mounting said lifeline means for generally upright disposition above the roof at the peak thereof comprising frame means for receiving said lifeline means and shoulder means extending from said frame means for engagement against said roof on opposing pitched sides thereof;

securing means for securing said lifeline means to said frame means; and anchoring means for anchoring said shoulder means to said roof.

2. The safety system of claim 1 wherein said frame means comprises a frame having four panels forming an enclosure having a generally rectangular upper opening, said frame closely receiving said lifeline means.

3. The safety system of claim 1 wherein said shoulder means comprise a pair of plates which are disposed at an angle to each other, each said plate engaging opposed pitched portions of said roof in substantially surface-to-surface relationship.

4. The safety system of claim 1 wherein said securement means comprises a pin, said frame means further comprise a pair of spaced panels and means defining aligned openings through said spaced panels, and said housing defines an aperture, said pin being insertable through said panel openings and said aperture.

5. The safety system of claim 1 wherein said shoulder means further defines an opening and said anchoring means comprises a generally J-shaped bolt comprising a hook and a threaded shank, and a nut threadably engageable to said shank and torqueable against said shoulder.

6. The safety system of claim 5 wherein each said shoulder defines an opening, and said anchoring means comprises a pair of substantially identical generally J-shaped bolts.

7. An anchor assembly comprising:

a quasi-J-shaped member comprising a hook portion and an elongated shank having a threaded surface and a connector ring integrally extending from said shank generally opposite said hook portion; and a nut threadably engagable with said threaded surface for threadable longitudinal displacement therealong, said nut comprising at least one wing arm extending generally transversely thereto.

8. The anchor assembly of claim 7 further comprising a plate, said plate defining an opening dimensioned to receive said shank.

9. The anchor assembly of claim 7 wherein said nut further comprises a pair of substantially identical wing arms projecting in opposite directions.

10. The anchoring system of claim 3 wherein said plates are connected by a hinge and said plates are relatively positionable at a range of angles.

* * * * *